United States Patent [19]

Randall

[11] Patent Number: 5,070,372

[45] Date of Patent: Dec. 3, 1991

[54] METHOD AND APPARATUS OF FORMING COMBINED TONER IMAGES

[75] Inventor: Kent A. Randall, Webster, N.Y.

[73] Assignee: Eastman Kodak Company, Rochester, N.Y.

[21] Appl. No.: 601,629

[22] Filed: Oct. 22, 1990

[51] Int. Cl.[5] ..... G03G 15/14; G03G 15/16

[52] U.S. Cl. ..... 355/272; 355/271; 355/274; 355/276; 355/326; 355/328; 430/126

[58] Field of Search ..... 355/271-274, 355/276, 244, 319, 326-328, 24; 430/126

[56] References Cited

U.S. PATENT DOCUMENTS

| | | | |
|---|---|---|---|
| Re. 32,422 | 5/1987 | DiFrancesco et al. | 430/126 |
| 4,214,831 | 7/1980 | Reesen | 355/24 X |
| 4,352,549 | 10/1982 | Ozawa | 355/272 |
| 4,428,662 | 1/1984 | Day | 355/327 |
| 4,436,404 | 3/1984 | Simmons et al. | 355/319 |
| 4,477,176 | 10/1984 | Russel | 355/313 |
| 4,688,925 | 8/1987 | Randall . | |
| 4,712,906 | 12/1987 | Bothner et al. . | |
| 4,714,939 | 12/1987 | Ahern et al. . | |

FOREIGN PATENT DOCUMENTS

| | | | |
|---|---|---|---|
| 8904510 | 5/1989 | World Int. Prop. O. | 355/326 |

OTHER PUBLICATIONS

*Xerox Disclosure Journal*, vol. 9, No. 20, Jan./Feb. 1984, pp. 47-48, Andrews, Ronald A., "Single Pass Duplex in Electronic Systems."

*Primary Examiner*—A. T. Grimley
*Assistant Examiner*—Matthew S. Smith
*Attorney, Agent, or Firm*—Leonard W. Treash, Jr.

[57] ABSTRACT

Toner images are combined for later transfer to a receiving sheet by forming first and second toner images on an image member and transferring the first toner image to an intermediate member. The first toner image is transferred back to the image member in registration with a second toner image to form a combined toner image.

17 Claims, 2 Drawing Sheets

METHOD AND APPARATUS OF FORMING COMBINED TONER IMAGES

RELATED APPLICATIONS

This application is related to co-assigned:

U.S. patent application Ser. No. 07/601,539, filed Oct. 22, 1990, METHOD AND APPARATUS FOR HANDLING TONER IMAGES, in the name of Kent A. Randall.

U.S. patent application Ser. No. 07/601,630, filed Oct. 22, 1990, MULTIPURPOSE IMAGING APPARATUS, in the name of Kent A. Randall.

U.S. patent application Ser. No. 07/601,538, filed Oct. 22, 1990, IMAGING APPARATUS UTILIZING INTERMEDIATE TRANSFER MEMBER, in the name of Kent A. Randall.

FIELD OF THE INVENTION

This invention relates to the formation of toner images which are a combination of previously formed toner images.

BACKGROUND ART

Present commercial apparatus has the capability of combining images in copying or printing. For example, a textural image can be combined with suitable graphics or pictorials to form a single image having both text and graphics and/or pictorials. Similarly, a single color original can be reproduced with certain portions highlighted by reproduction in a different color from the rest of the reproduction. A related capability breaks down a multicolor original into its component colors and reproduces that original.

In attaining all of the above results using electrostatic imaging, the most common commercial approach is to create two or more toner images on a single image member and then to tranfer them in registration to a receiving sheet to form a combined toner image.

In apparatus that function primarily as a single color, office copier or printer, the most common way of presenting a receiving sheet to a plurality of toner images is to feed the sheet back to the image member along a path normally used for duplex. One inversion is added or subtracted to the duplex path to present the side of the sheet already holding an image to receive a second image. With this system, registration of combined images is dependent upon accurate cross track, in-track and skew registration of the receiving sheet recirculation mechanism. Very high quality registration has not been obtainable with this system. Acceptable registration generally requires a more sophisticated receiving sheet handling mechanism then is used in an ordinary duplex path. Results are also adversely affected by repeated passes of the receiving sheet through a fuser.

The most commonly used approach for combining three or more single color images to make a high quality multicolor image is to attach the receiving sheet to a transfer drum and rotate it repeatedly through transfer relation with the image member to superpose the images on the receiving sheet. The transfer drum and its sheet attaching mechanism are quite expensive and represent difficult technology to accomplish. When successfully implemented, they provide high-quality registration of the images being combined. The results are sufficiently good that the expense of a transfer drum is sometimes undertaken to obtain highest quality in highlight color applications.

A number of references suggest that images can be combined by transferring them in registration to an intermediate transfer member, for example, a drum or a web from which they are transferred to a receiving sheet. See, for example, U.S. Pat. No. 4,712,906, Bothner et. al., issued Dec. 15, 1987, which describes a multicolor imaging approach in which ledger-size images are transferred to an intermediate drum or web having a circumference large enough to handle a ledger-size image with its long dimension in the in-track direction. Letter-size images are positioned with their short dimension in the in-track direction transferring two letter-size images in the same space as a single ledger-size image.

U.S. Pat. No. 4,714,939, Ahern et. al., issued Dec. 22, 1987, is representative of a number of references which show a method of making duplex copies in which a first image is transferred to an intermediate and a receiving sheet is fed between the intermediate and the original image member while images are transferred from the intermediate and the image member to opposite sides of the single sheet. See also, U.S. Pat. No. 4,688,925, Randall, issued Aug. 25, 1987.

STATEMENT OF THE INVENTION

It is an object of the invention to provide a method and apparatus for combining toner images which has good registration but without the expense and technical problems of a transfer drum with a sheet holding mechanism.

These and other objects are accomplished by forming a plurality of toner images on an image member, transferring one or more of those toner images to an intermediate member and then transferring the one or more images back to the image member in registration with another toner image to form a combined toner image on the original image member. The combined toner image may then be transferred in one step to a receiving sheet, or otherwise utilized.

This approach provides registration comparable to that of tacking a receiver sheet to a rotating transfer drum. It is considerably less expensive than the rotating transfer drum. It permits the utilization of the ordinary transfer mechanism of a copier or printer in transferring images to a receiving sheet. That is, the receiving sheet need not be capable of being attached to a transfer drum. It lends itself to any duplexing system, including single pass duplexing of several types.

Any two or more toner images that can be formed on an image member can be combined in this manner. For example, two images of the same color from different originals can be combined into a single combined toner image. Two images from the same or different originals can be made in different colors and combined to make a two or more color combined toner image. Toner images formed by different means, for example, electronic and optical means can be combined into a single image. Two images of the same color, but of different characteristics, for example, magnetic and non-magnetic, can also be combined.

In this invention, the intermediate member performs the function of an image buffer which positions the image back on the image member but at a different location. The intermediate member can be either an endless web or a drum. Preferably, it should be equal in length to the pitch of the images. However, modern copiers and printers produce a variety of sizes of outputs, including both letter-size and ledger-size outputs. In such environments, according to a preferred embodiment, the intermediate member can have a circumference equal to the pitch of ledger-size images with the long dimension in the in-track direction. Letter-size images can then be formed with the short dimension in the in-track direction, forming two letter-size combined images in the same space that one ledger-size image is formed.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
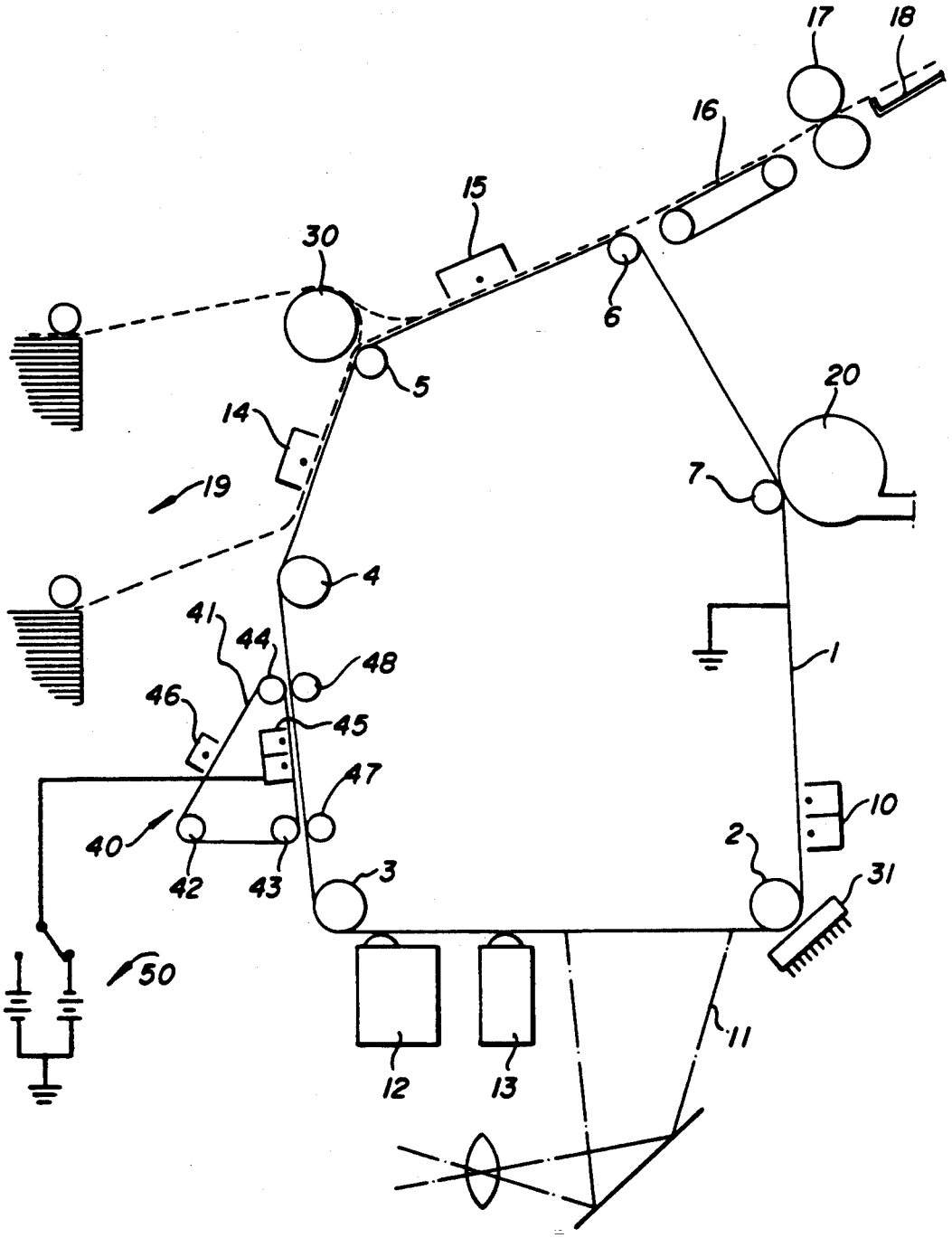
FIG. 1 is a side schematic of an electrophotographic apparatus for carrying out the invention.

FIG. 1 shows an electrophotographic apparatus for making copies or prints either optically or electronically. According to FIG. 1, an image member, for example, an endless photoconductive belt 1, is trained about a series of rollers 2, 3, 4, 5, 6 and 7. One of the rollers is driven to drive the image member 1 past a series of electrophotographic stations, most of which are conventional.

In normal, conventional operation, image member 1 is uniformly charged by a primary charging station 10 and imagewise exposed at an exposure station 11 to create an electrostatic image. The electrostatic image is toned by a black (or other color) toner station 12 to create a toner image and the toner image is transferred to a receiving sheet at a simplex transfer station 15. The receiving sheet is fed from a receiving sheet supply 19 to transfer station 15. It is separated from image member 1 as image member 1 goes around small roller 6 and is transported by a belt transport 16 to a fuser 17 where the image is fused to the receiving sheet. The receiving sheet is finally deposited in an output tray 18. The image member is cleaned by a conventional cleaning device 20 for reuse.

In conventional single pass duplex operation, the receiving sheet is fed to a duplex transfer station 14 to receive a first toner image. It is turned over at a turnover station 30 and refed to simplex transfer station 15 to receive a second toner image on the opposite side. After separation at roller 6, a known duplex transport 16 transports the sheet to duplex fuser 17 without disturbing either unfixed toner image. Both toner images are fused simultaneously by duplex fuser 17, and the duplex copy is deposited in tray 18. Depending on the order of the images, the sheet may be turned over before depositing in the tray. This duplex method is known as "single pass" duplexing. It is characterized by a short receiving sheet path and a single fusing step for both images. However, it is difficult to adapt to conventional image combining systems.

To combine toner images according to the invention, a toner image buffer 40 is provided along the path of image member 1 between toning station 12 and transfer stations 14 and 15. Toner image buffer 40 is shown in FIG. 1 as an endless belt intermediate member 41 entrained about rollers 42, 43 and 44. Rollers 43 and 44 are directly opposite rollers 47 and 48 respectively backing image member 1 and assuring a close transfer relationship between intermediate member 41 and image member 1. An electrically reversible corona charger 45 backs a portion of intermediate member 41 which faces and is in transfer relationship with image member 1. A conditioning corona 46 is positioned adjacent intermediate member 41 at a position remote from image member 1.

In operation, consecutive electrostatic images to be combined are formed by primary charger 10 and exposure station 11. Both electrostatic images can be toned by toning station 12 if a single-color combined image is desired. However, for images combining two different toners, for example, magnetic and non-magnetic toners or to make two-color images, for example, in making highlight color reproductions, one image is toned by toner station 12 and a second image is toned by a toner station 13. Toner station 13 contains magnetic toner or highlight color toner.

The first toner image thus formed is transferred by reversible charger 45 to intermediate member 41 as both intermediate member 41 and image member 1 are driven at equal speeds and in transfer relation. The first toner image is held by electrostatic forces created by the combination of charge on the toner image and charge from charger 45. This attraction is loosened by conditioning charger 46 which sprays a charge of polarity opposite that of the toner onto the image. Charger 46 can also be an AC charger appropriately biased to neutralize the forces holding the toner to intermediate member 41. The first toner image approaches the image member 1 as the second toner image approaches intermediate member 41. The polarity on reversible charger 45 is reversed at a voltage source 50. The first toner image is transferred back to image member 1 in registration with the second toner image to provide a combined toner image.

In simplex operation, the combined toner image is transferred to a receiving sheet at simplex transfer station 15 and the image is fused by fuser 17. In duplex operation, four toner images can be created on image member 1. The first toner image is transferred to intermediate member 41 and then transferred back in registration with the second toner image on primary image member 1. The third toner image, similar to the first toner image is transferred to the intermediate member 41 and then transferred back to primary image member 1 in registration with the fourth toner image. The combined first and second toner images are then transferred to the first side of a receiving sheet at duplex transfer station 14. The receiving sheet is turned over at turnover station 30 and the combined toner image made up of the third and fourth toner images is transferred to the other side of the receiving sheet at simplex transfer station 15. All four toner images, i.e., both combined toner images, are fused by duplex fuser 17 simultaneously. Thus, the advantages of single pass duplexing are realized with combined or multicolor images.

Images can be combined from different originals placed in the original plane (not shown), of exposure station 11. Images may be combined from the same original with different portions of the electrostatic image erased in the two images. To accomplish this, an LED printhead 31 is positioned opposite roller 2 and is connected to suitable electronics which are not shown, but are known, per se, to erase a portion of the image frame approaching exposure station 11, which portion of the frame is not to be imaged in one particular color. The rest of the frame would be erased in the next image to provide complementary charged image frames to exposure station 11. The two electrostatic images formed by exposure station 11 would then be toned by stations 12 and 13 and combined at buffer 40 to form a combination image whose colors are defined by the charge erasing done at erasing printhead 31. Printhead 31 can also be used to electronically form images. Thus, an image formed electronically by printhead 31 can be combined with an image formed optically by exposure station 11 again using image buffer 40. This approach can be used to electronically print letterheads or forms while optically forming a varying text, graphics or other image. Another application could be to print text electronically and add pictorial or graphic information optically. Alternatively, optical exposure station 11 can be eliminated and all images formed by printhead 31 converting the apparatus entirely to an electronic printer.

Three images may be combined by first transferring two images in registration to intermediate member 41 to create a combined image which is a combination of those two images. The combined image is then transferred back to image member 1 in registration with another image to form a three-image combination. This approach can be used to form three-color images using a third toning station, not shown, or to combine graphics and text from different originals and make portions of one of the other into two colors. Obviously, four or more images may also be combined.

Figure 2:
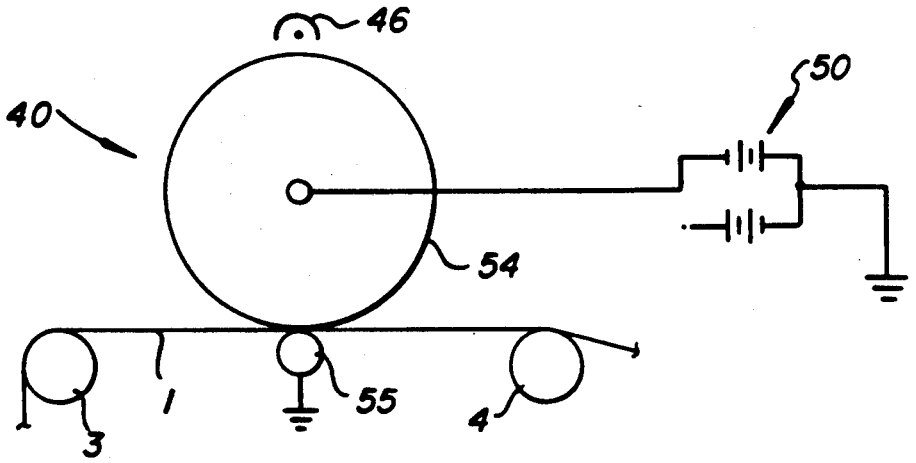
FIG. 2 is a side schematic of a portion of an electrophotographic apparatus comparable to that shown in FIG. 1 but illustrating an alternative embodiment of the invention.

FIG. 2 shows an alternative embodiment of the image buffer 40. According to FIG. 2, intermediate belt 41 has been replaced by an intermediate drum 54 whose circumference is equal to the length of belt 41. As with image member 41, images are transferred from image member 1 to the periphery of drum 54 and then transferred back to image member 1 in registration with subsequent images. Transfer is accomplished by biasing drum 54 with reversible voltage source 50. Image member 1 is backed by a grounded backing roller 55 opposite drum 54.

Intermediate image members 41 and 54 preferably have an in-track dimension equal to the pitch of the images formed on image member 1. However, modern copiers and printers image on a variety of sizes of receiving sheets, including both ledger-size and letter-size sheets. To accommodate both sizes with greatest efficiency, intermediate members 41 and 54 can be equal in in-track dimension to the pitch of ledger-size images with their long dimension positioned in the in-track direction. If letter-size images are then positioned with their shorter dimension in the in-track direction, two letter-sized images can be transferred to a single intermediate member 41 or 54 at a time. In this approach, two letter-size images to be combined would be separated by another letter-size image area which may or may not be used.

Figure 3:
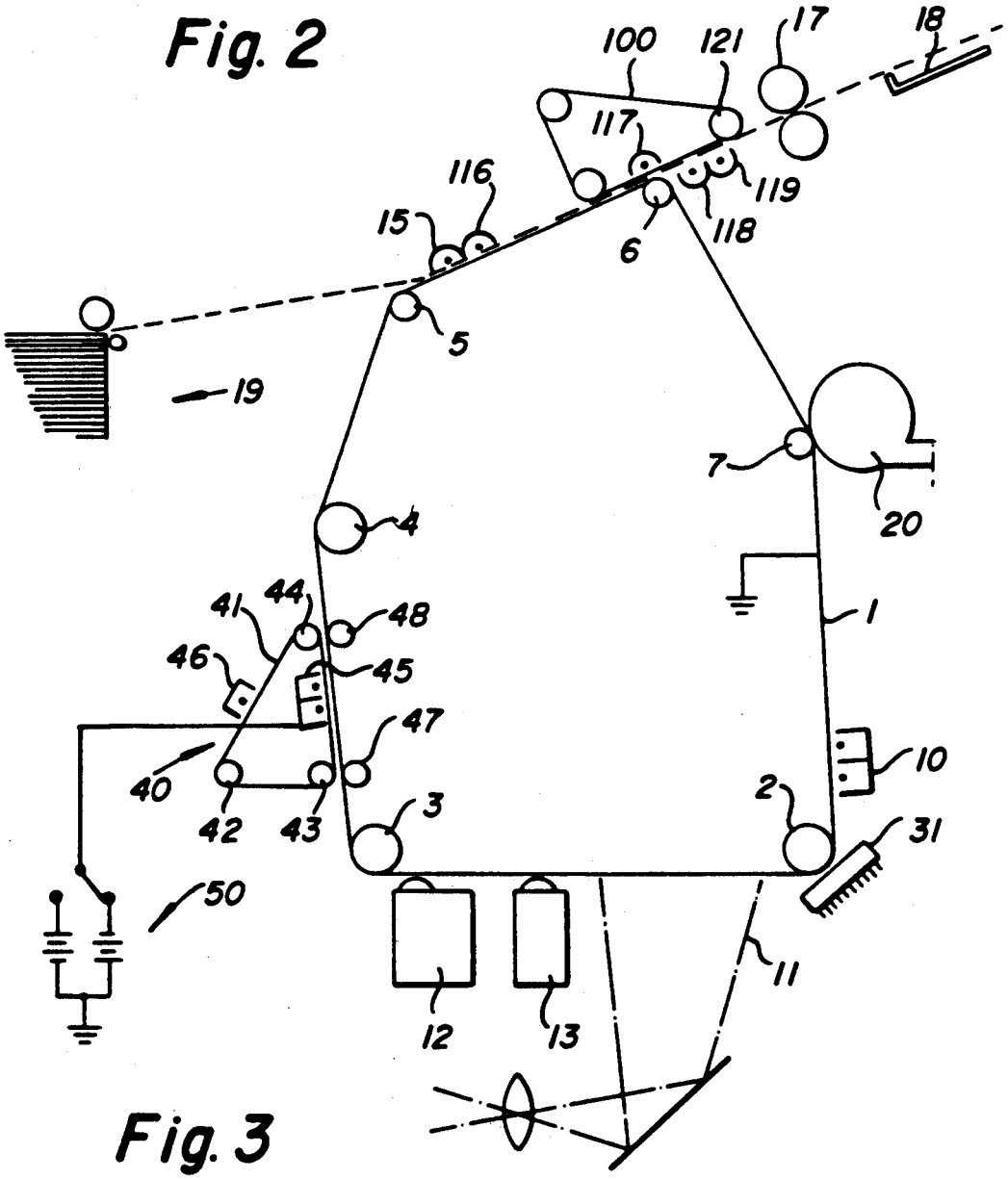
FIG. 3 is a side schematic similar to FIG. 1, but illustrating a different duplexing scheme in combination with the invention than that shown in FIG. 1.

FIG. 3 shows the image buffer 40 of FIG. 1 in apparatus having a different duplexing approach. This approach is similar to that shown in U.S. Pat. No. 4,714,939 referred to above.

According to FIG. 3, consecutive combined or not combined images are formed on image member 1 as in FIG. 1. The first image passes under simplex charger 15, which is turned off. It is transferred to a duplex intermediate member 100 using a corona, a roller or bar 117 opposite separation roller 6. A receiving sheet is fed from supply 19 to simplex transfer station 15 to receive the second image on its bottomside. A separation charger 116 can be used to loosen the sheet for separation from image member 1. As the receiving sheet separates from image member 1 as image member 1 passes around roller 6, it is electrostatically picked up by duplex intermediate member 100. Transfer corona 117 can be turned off at this point. The first image is transferred to the top side of the sheet by duplex transfer charger 118. This transfer does not affect the image on the bottom of the sheet, because the image member 1 no longer contacts it and the image has no where to go. The sheet can be electrostatically loosened by separation corona 119 and is separated from member 100 as member 100 passes around a small roller 121. If the location of duplex fuser 17 permits, duplex intermediate member 100 can be used to transport the sheet to the fuser 17, eliminating an expensive duplex transport shown in FIG. 1.

Note that if intermediate member 100 is a single frame in circumference, it will have to make an extra non-transferring rotation or cycle between images if the next image is a combined one. This is because there will be a frame from which an image has been combined to the following frame between transferrable toner images. If the second image is not combined, no such extra cycle is necessary. If member 100 is two frames in circumference, appropriate skip frames will have to be made in exposure when doing uncombined images, but no such extra cycle of member 100 will be necessary even though the image transferred to the bottom of the receiving sheet is a combination of two images. Most flexibility is obtained if both buffer intermediate member 41 and duplex intermediate 100 are a single frame in length.

The FIG. 3 apparatus has the substantial advantage of a reliable, straight paper path in doing duplex. With the buffer 40, it adds a high registration combined image capability.

Although image member 1 is shown as an endless belt, it could also be in the form of a drum and work with a buffer intermediate member or duplex intermediate member which is either a belt or a drum.

Note that this approach combines images without altering the receiving sheet handling approach of the apparatus. Typically, a high volume copier or printer is operated a very high percentage of its time in a single color simplex or duplex mode. The receiving sheet path has not been altered from the optimum design. In FIG. 1, single pass duplexing is used, which is a system that has not been used with conventional image combining systems.

The invention has been described in detail with particular reference to a preferred embodiment thereof, but it will be understood that variations and modifications can be effected within the spirit and scope of the invention as described hereinabove and as defined in the appended claims.

I claim:

1. A method of forming combined toner images comprising:

forming first and second toner images on an image member, transferring said first image to an intermediate member, and transferring said first image back to said image member in registration with said second image to form a combined toner image on said image member.

2. The method according to claim 1 including the additional step of transferring the combined toner image to a receiving sheet.

3. The method according to claim 1 including the further step of transferring one or more additional toner images to said intermediate member in registration with the first toner image and transferring said first and additional images back to said image member in registration with said second toner image.

4. The method according to claim 1 wherein said first and second toner images are formed by toning first and second electrostatic images with toners of different color.

5. Toner image-forming apparatus comprising:

an image member, an intermediate member, means for forming first and second toner images on said image member, means for transferring said first image from said image member to said intermediate member, and means for transferring said first toner image from said intermediate member back to said image member in registration with said second toner image to form a combined toner image of said first and second toner images on said image member.

6. Toner image-forming apparatus comprising:

an image member movable through an endless path past a series of stations, an intermediate member movable through an endless path, a portion of said path bringing it into transfer relation with said image member, means for forming first and second electrostatic images on said image member, means for toning said electrostatic images to form first and second toner images, means for transferring said first toner image from said image member to said intermediate member, means for transferring said first toner image from said intermediate member back to said image member in registration with said second toner image to form a combined toner image of said first and second images on said image member.

7. Apparatus according to claim 6 further including means for transferring said combined toner image to a receiving sheet.

8. Apparatus according to claim 6 further including means for forming an additional electrostatic image before forming said second electrostatic image and means for toning said additional electrostatic image to create an additional toner image and means for transferring said additional toner image to said intermediate member in registration with said first toner image, said first and additional toner images being transferred back to said image member in registration with said second toner image in a single step.

9. Apparatus according to claim 8 wherein said toning means includes means for applying a toner of a first color to said first image and means for applying a toner of a second color to at least one of said second image and said additional image.

10. Apparatus according to claim 6 wherein one of said electrostatic images is formed by optical exposure of said image member and the other electrostatic image is formed by electronic exposure of said image member.

11. Apparatus according to claim 6 further including means for forming third and fourth electrostatic images on said image member and for toning said third and fourth electrostatic images to create third and fourth toner images and for transferring said third toner image to said intermediate member and then back to said image member in registration with said fourth toner image to create a second combined toner image and wherein said apparatus further includes means for transferring the first combined toner image to a first side of a receiving sheet and the second combined toner image to the second side of the same receiving sheet to form duplex combined toner images on said receiving sheet.

12. Apparatus according to claim 10 wherein said apparatus further includes means for fusing said combined toner images to both sides of said receiving sheets simultaneously.

13. Apparatus according to claim 6 wherein said intermediate member is an endless belt entrained about a plurality of rollers.

14. Apparatus according to claim 6 wherein said intermediate member is a drum.

15. Apparatus according to claim 6 including a reversible field creating means for first transferring a toner image from said image member to said intermediate member and then transferring said toner image back to said image member.

16. Apparatus according to claim 6 wherein said toning means includes a first toning means for applying a toner of a first color to said first image and a second toning means for applying a toner of a second color to said second image.

17. Apparatus according to claim 6 wherein said intermediate member has an in-track peripheral dimension equal to the pitch of ledger-sized images positioned with their long dimension in an in-track direction and equal to the pitch of pairs of letter-size images positioned with their small dimension in an in-track direction.

* * * * *